US006352463B2

(12) United States Patent
Forkman

(10) Patent No.: US 6,352,463 B2
(45) Date of Patent: Mar. 5, 2002

(54) MAGNETIC COUPLING DEVICE ON A TOY VEHICLE

(75) Inventor: Kristian Forkman, Osby (SE)

(73) Assignee: Brio AB, Osby (SE)

( * ) Notice: Subject to any disclaimer, the term of this patent is extended or adjusted under 35 U.S.C. 154(b) by 0 days.

(21) Appl. No.: 09/739,247

(22) Filed: Dec. 19, 2000

(30) Foreign Application Priority Data

Dec. 21, 1999 (SE) ..... 9904681

(51) Int. Cl.[7] ..... A63H 33/26
(52) U.S. Cl. ..... 446/138; 446/129; 213/75 D
(58) Field of Search ..... 446/129, 137, 446/138, 92, 131; 213/75 TC, 75 D

(56) References Cited

U.S. PATENT DOCUMENTS 2,939,245 A * 6/1960 Orel ..... 446/138
3,330,066 A * 7/1967 Crawford ..... 213/75 D
5,048,704 A * 9/1991 Takahashi ..... 213/75 D
5,427,561 A * 6/1995 Eichhorn et al. ..... 446/463
5,681,202 A * 10/1997 Sander ..... 446/138

FOREIGN PATENT DOCUMENTS

GB 1 437 426 5/1976

* cited by examiner

*Primary Examiner*—Kien T. Nguyen
(74) *Attorney, Agent, or Firm*—Browdy and Neimark, PLLC

(57) ABSTRACT

A magnetic coupling device on a toy vehicle has a magnetic element and a fixing element, by means of which the magnetic element is fixed to the vehicle. The fixing element has a dome-shaped coupling surface, which is arranged to be kept in abutment by magnetic attraction against a coupling surface of a coupling device on another toy vehicle. Inside the coupling surface, the fixing element has an inner cavity, in which the magnetic element is arranged to be freely movable.

4 Claims, 2 Drawing Sheets

MAGNETIC COUPLING DEVICE ON A TOY VEHICLE

FIELD OF THE INVENTION

The present invention relates to a magnetic coupling device on a toy vehicle, said device having a magnetic element and a fixing element, by means of which the magnetic element is fixed to the vehicle and which has a substantially dome-shaped coupling surface, which is arranged to be kept in abutment by magnetic attraction against a coupling surface of a coupling device on another toy vehicle.

BACKGROUND ART

In a prior-art magnetic coupling device of this kind (see SE 7301083-7), the magnetic element consists of a disk-shaped magnet with a through center hole and the fixing element consists of a metal nail with a head and a shank. The magnet is nailed to the toy vehicle by means of the nail, whose shank extends through the center hole of the magnet and whose head abuts against the magnet and presses the same to abut against the vehicle. Thus, the magnet is kept fixed to the vehicle. The surface of the nail head facing away from the magnet is dome-shaped and forms the coupling surface of the magnetic coupling device.

When two toy vehicles, each provided with at least one such prior-art magnetic coupling device, are coupled to each other by means of two coupling devices, whose magnets are oriented such that their portions facing the respective coupling surfaces have opposite polarity (north and south), the coupling surfaces of the two devices are kept in abutment against each other by the magnetic attractive force. When the magnets of the two coupling devices are oriented such that their portions facing the respective coupling surfaces have the same polarity (north or south), the coupling surfaces are instead repelled from each other. Each toy vehicle is usually provided with two magnetic coupling devices, which have different outwardly directed polarity and of which one is mounted in the front part of the toy vehicle and the other is mounted in its rear part. Therefore it is important that two toy vehicles, which are to be coupled to each other, be turned in the right direction in relation to each other in order to permit coupling. Thus, it may be difficult for small children to couple the toy vehicles.

To find a remedy for this, magnetic coupling devices are provided, which have a magnetic element, which is arranged to rotate on a shaft extending transversely of the driving direction of the toy vehicle, said shaft being supported by two arms, which project from the end of the toy vehicle. Since in this case the magnetic element can rotate, it automatically takes the correct position, i.e. such a position that its north magnetic pole is directed towards a south magnetic pole and vice versa, when the magnetic coupling device is moved towards another magnetic coupling device.

Thus, if a first toy vehicle, which is provided with a magnetic coupling device of this kind, is to be coupled to a second toy vehicle, which is provided with a magnetic coupling device, a coupling is provided irrespective of how the poles of the magnetic element in the coupling device of the second toy vehicle are oriented.

However, the above-described solution suffers from the great drawback that the magnetic coupling device can easily break if the toy vehicle is treated roughly and, for instance, dropped on the floor. The projecting arms, on which the magnetic element is rotatably mounted, can easily be snapped off.

SUMMARY OF THE INVENTION

Therefore the object of the present invention is to provide a magnetic coupling device, which solves the problem described by way of introduction while having a robust and strong design.

According to the present invention, this object is achieved by a magnetic coupling device, which is of the kind stated by way of introduction and characterized in that the fixing element inside the coupling surface has an inner cavity, in which the magnetic element is arranged to be freely movable.

In a preferred embodiment, the fixing element has a head, whose outer surface forms the substantially dome-shaped coupling surface and in which the cavity is formed, and a shank, which projects from the head and which extends into a hole in the toy vehicle and is fixed in said hole.

In another preferred embodiment, the fixing element substantially has the form of a button, which is fixed to the toy vehicle.

Advantageously, the fixing element is made of plastic material.

BRIEF DESCRIPTION OF THE DRAWINGS

The invention will now be described in more detail with reference to the accompanying drawings.

DESCRIPTION OF THE PREFERRED EMBODIMENT

Figure 1:
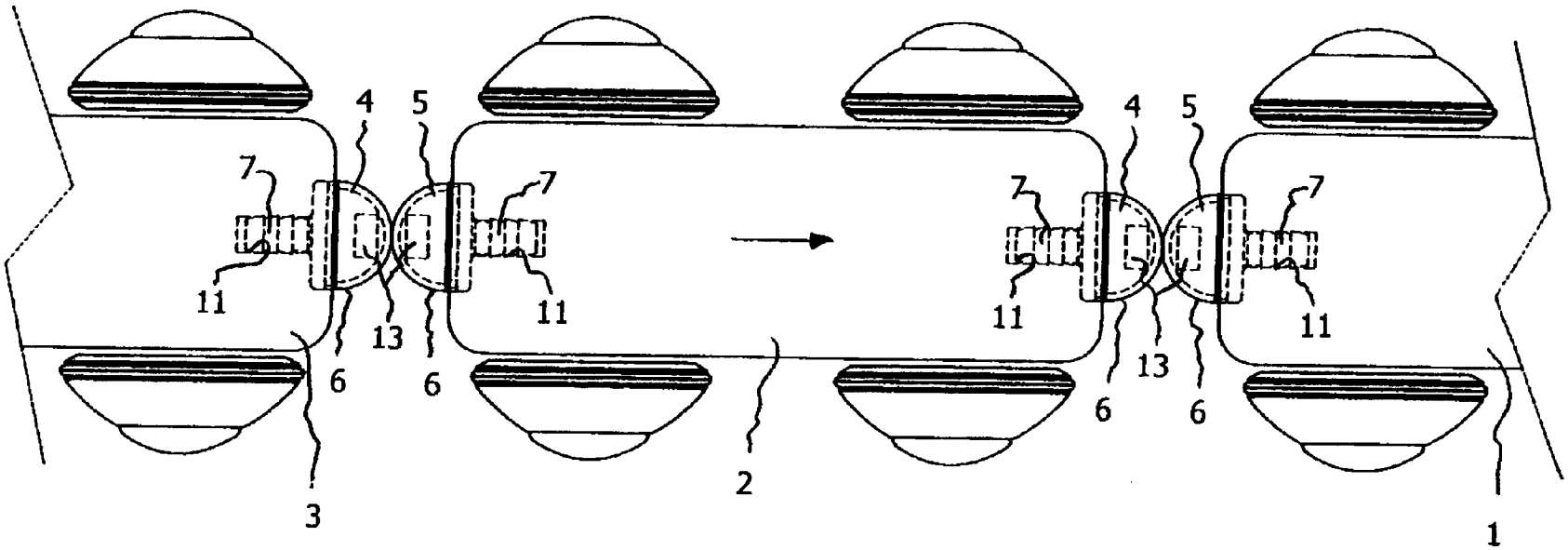
FIG. 1 is a top plan view showing how three toy vehicles are coupled to each other by means of magnetic coupling devices according to the invention.
Figure 2:
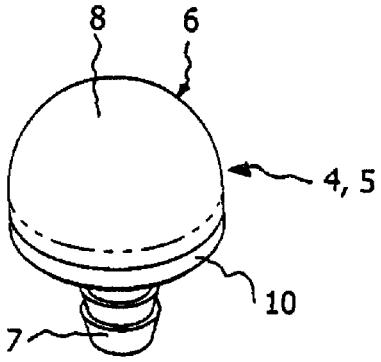
FIG. 2 is a perspective view showing a magnetic coupling device according to the invention.
Figure 3:
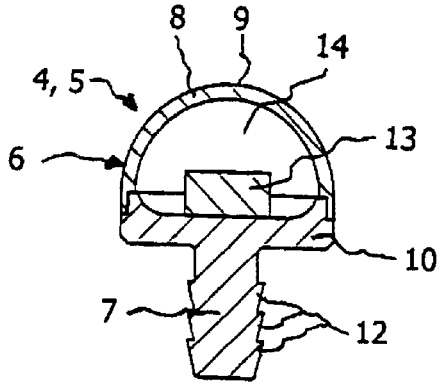
FIG. 3 shows the magnetic coupling device according to FIG. 2 in longitudinal section.
Figure 4:
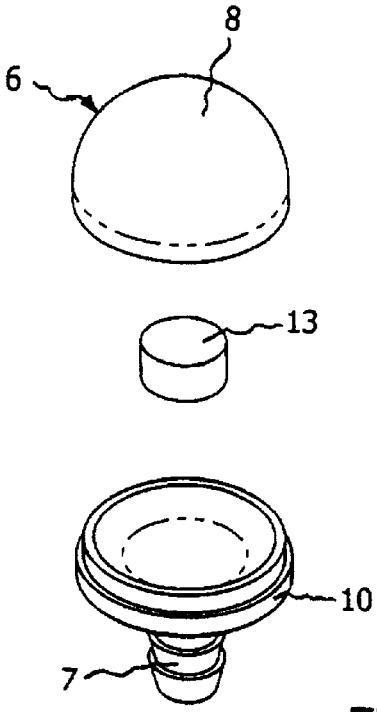
FIG. 4 is an exploded view showing the magnetic coupling device according to FIGS. 2 and 3.

FIG. 1 shows three toy vehicles 1, 2 and 3 in the form of wagons, which are part of a toy train driven on a railway track (not shown) composed of wood elements. The driving direction of the train is indicated by an arrow. The wagons 1, 2 and 3 each have a front and a rear magnetic coupling device 4 and 5, respectively, according to the invention. The front wagon 1 and the middle wagon 2 are coupled to each other by means of the rear magnetic coupling device 5 of the front wagon 1 and the front magnetic coupling device 4 of the middle wagon 2. The middle wagon 2 and the rear wagon 3 are coupled to each other by means of the rear magnetic coupling device 5 of the middle wagon 2 and the front magnetic coupling device 4 of the rear wagon 3.

The magnetic coupling devices 4, 5 are made of plastic material and each have a head 6 and a shank 7. The head 6 consists of a substantially part-spherical shell 8, which has a substantially dome-shaped outer surface 9, which forms the coupling surface of the magnetic coupling device 4, 5, and a disk 10, which is formed at one end of the shank 7 and to which the shell 8 is fixed, for instance, by gluing or ultrasonic welding.

As shown in FIG. 1, the shank 7 and the disk 10 are inserted into a shoulder bore 11 in the wagon 1, 2 or 3 and kept therein by means of circumferential, barb-like beads 12 on the shank 7.

A disk-shaped magnet 13 made of so-called super-magnetic material is arranged to be freely movable inside the head 6, i.e. in the cavity 14 between the shell 8 and the disk 10. The magnet 13 can move freely in the cavity 14 and take any position therein. The north pole of the magnet 13 is situated at one of its circular surfaces and its south pole at its other circular surface.

When the magnetic coupling device 4, 5 is moved towards an arbitrary magnetic element, its magnet 13 automatically adjusts depending on which magnetic pole of this magnetic element is facing the magnetic coupling device 4, 5. The north pole of the magnet 13 is turned towards the magnetic element if the south pole of the magnetic element is facing the magnetic coupling device 4, 5, and the south pole of said magnet is turned towards the magnetic element if the north pole of the magnetic element is facing the magnetic coupling device 4, 5. When two magnetic coupling devices 4, 5 according to the invention are approaching each other, their two magnets 13 adjust in such manner that the devices attract each other. As a result, two wagons 1, 2 or 3 are coupled to each other irrespective of which magnetic coupling device 4 or 5 on one wagon is moved towards a magnetic coupling device 4 or 5 on the other wagon.

The described magnetic coupling device can be modified in many different ways within the scope of the invention. Thus, the fixing element which is formed by the head 6 and the shank 7 and intended for fixing the magnet to the wagon 1, 2 or 3 can be replaced by a fixing element in the form of a button, which corresponds to the head 6 but without a shank. This button can be fixed to the wagon 1, 2 or 3 in arbitrary manner, for instance, by gluing.

What I claim and desire to secure by Letters Patent is:

1. A magnetic coupling device on a toy vehicle, said device having a magnetic element and a fixing element, by means of which the magnetic element is fixed to the vehicle and which has a substantially dome-shaped coupling surface, which is arranged to be kept in abutment by magnetic attraction against a coupling surface of a coupling device on another toy vehicle, characterized in that the fixing element inside the coupling surface has an inner cavity, in which the magnetic element is arranged to be freely movable.

2. A device as claimed in claim 1, wherein the fixing element has a head, whose outer surface forms the substantially dome-shaped coupling surface and in which the cavity is formed, and a shank, which projects from the head and which extends into a hole in the toy vehicle and is fixed in said hole.

3. A device as claimed in claim 1, wherein the fixing element substantially has the form of a button, which is fixed to the toy vehicle.

4. A device as claimed in any one of the preceding claims, wherein the fixing element is made of plastic material.

* * * * *